United States Patent [19]

Lister et al.

[11] 4,062,169

[45] Dec. 13, 1977

[54] PACKAGING MACHINES

[75] Inventors: Edward Alan Lister, Burnley; Graham Wilson Clarke, Nelson, both of England

[73] Assignee: Brdr. Schur International A.S., Horsens, Denmark

[21] Appl. No.: 774,972

[22] Filed: Mar. 7, 1977

Related U.S. Application Data

[62] Division of Ser. No. 667,944, March 18, 1976.

[30] Foreign Application Priority Data

Mar. 20, 1975 United Kingdom ..... 11594/75

[51] Int. Cl.[2] ..... B65B 63/02; B65B 43/26

[52] U.S. Cl. ..... 53/124 D; 53/189; 53/258

[58] Field of Search ..... 53/124 D, 124 TS, 189, 53/252, 258, 260, 261, 262

[56] References Cited

U.S. PATENT DOCUMENTS

| | | | |
|---|---|---|---|
| 2,580,833 | 1/1952 | Piper et al. | 53/124 D X |
| 3,908,539 | 9/1975 | O'Brien | 53/124 D X |

*Primary Examiner*—Travis S. McGehee

[57] ABSTRACT

A packaging machine for inserting a batch of semi-compressible articles into preformed bags open at one end, having a longitudinal ram movable toward and away from the open bag and batch receiving means located at the leading end of the ram to carry the batch into the open bag, the batch receiving means having a pair of generally elongated flat parallel walls extending forwardly of the leading end of the ram and spaced from each other to receive the batch therebetween. At least one of said walls is flexible along its length and engages means located at the entrance of the bag by which it is deflected transversely of the direction of movement to impart a compressive force upon the articles as they are inserted into the bag.

6 Claims, 7 Drawing Figures

PACKAGING MACHINES

RELATED APPLICATION

This is a divisional application of Ser. No. 667,944, filed Mar. 18, 1976.

BACKGROUND OF THE INVENTION

This invention relates to packaging machines of the kind intended to insert semi-compressible articles into preformed bags.

The object of the invention is to provide such a machine in a simple and convenient form capable of achieving a tightly packed bag.

According to the invention, a packaging machine of the kind specified has means for supporting the bags in an open position and apparatus to insert a plurality of articles simultaneously into the bag. The apparatus for inserting the articles comprising a longitudinal ram movable toward and away from the open bag, receiving means located at the leading end of said ram to carry the articles in a batch into the open bag. The batch receiving means includes a pair of generally elongated flat parallel walls extending forwardly of the leading end of the ram and spaced to receive the articles therebetween. At least one of the walls is flexible along its length, and is adapted to engage means located at the entrance of the bag which deflects it transversely to the direction of movement imparting a compressive force upon the articles in the batch as they are inserted into the bag.

In particular, the machine includes an endless conveyor for feeding a plurality of articles in a relatively fixed oriented batch to the ram. The conveyor is disposed in line with and above the ram, and includes a pusher member movable in a vertical direction intersecting the line of movement of the ram. The pusher member cooperates with the conveyor to transfer the batch from the conveyor to the article receiving means, which then is capable of compressing the batch for insertion into the bag.

BRIEF DESCRIPTION OF THE DRAWINGS

One example of a packaging machine in accordance with the invention will now be described with reference to the accompanying drawings, in which:

With reference to FIG. 1 of the drawings, the machine comprises a conveyor section 10, a lift section 11, a loading section 12 and a bag sealing section 13. Moreover, associated with the loading section is a bag storage section 14.

Figure 1:
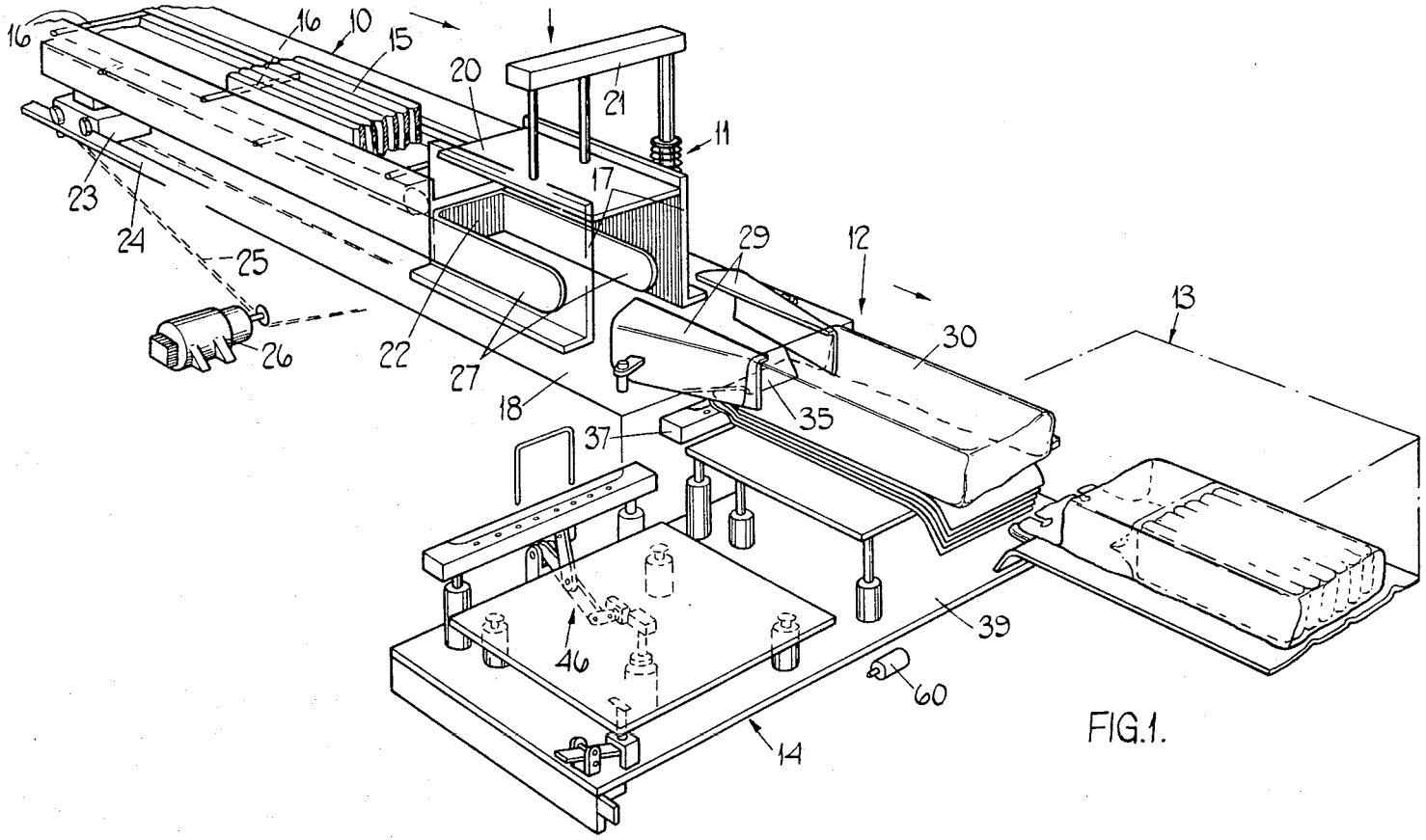
FIG. 1 is a perspective view of the machine.

The conveyor section 10 serves only to transport a group of towels 15 from a production machine (not shown) to the lift section 11. Briefly, the conveyor section comprises a pair of spaced endless chains between which extend bars 16, the bars being spaced in the direction of movement of the conveyor. The gap between following bars serves to accommodate a group of towels and at the end of the run of the conveyor, the group of towels is passed between a pair of side plates 17 which form part of the assembly section.

The side plates 17 are mounted on a base plate 18 which is itself carried on a supporting structure 19. Also forming part of the lift section is a vertically movable ram 20 which is movable between the plates 17. The ram is powered by a piston cylinder combination disposed on the outer side of one of the plates 17 and is connected by an overhead beam 21 which is attached to the ram by a pair of depending rods. In FIG. 1, the ram 20 is shown in the raised position waiting for a group of towels to be fed between the plates 17. Positioned below the conveyor section is a movable ram 22. The ram is mounted on a trolley 23 which is carried on a track 24. A chain 25 is coupled to the trolley 23 and is driven by a motor 26 to effect longitudinal movement of the ram.

Figure 2:
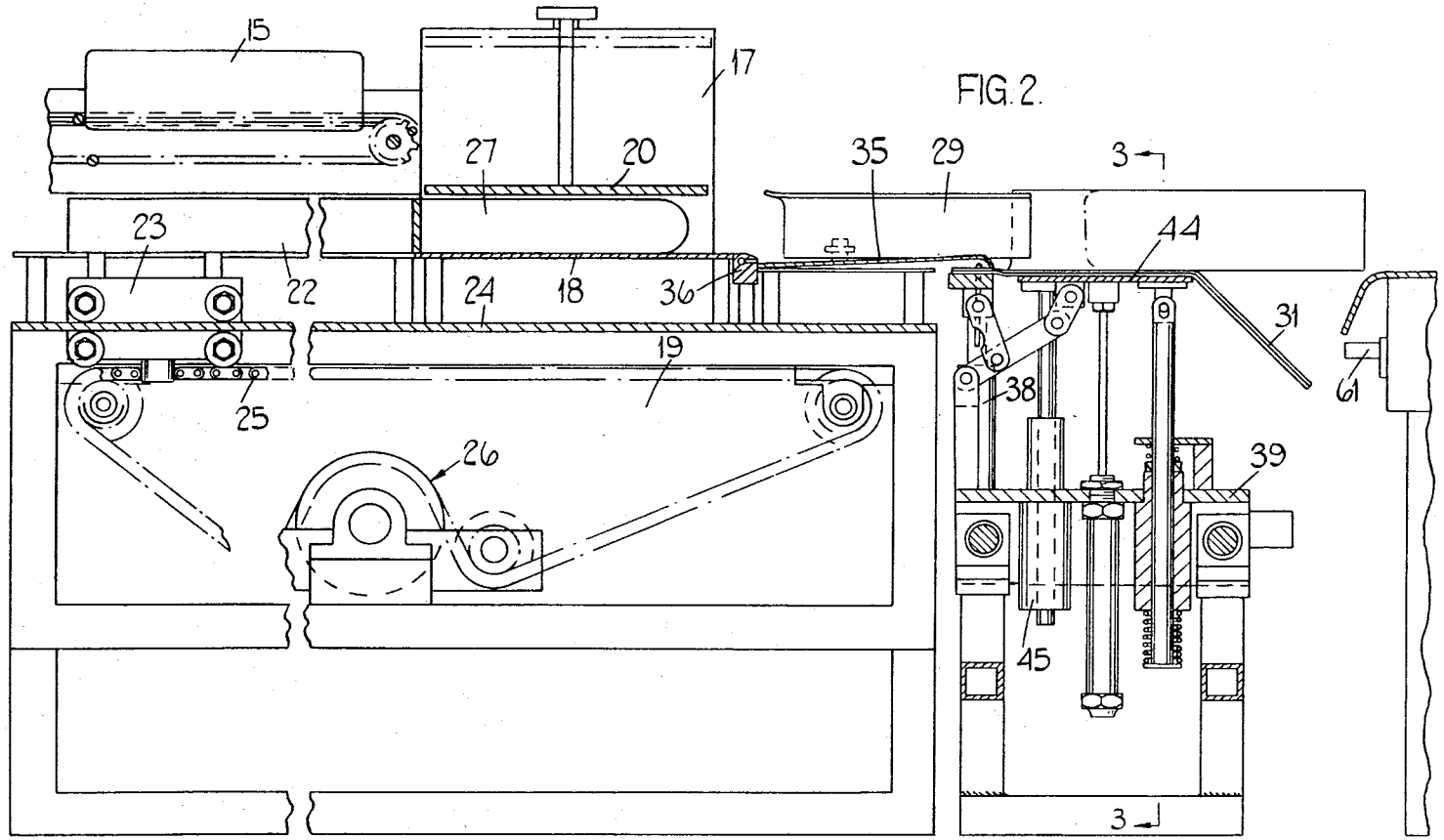
FIG. 2 is a side elevation of part of the machine as seen in FIG. 1.

In the retracted position of the ram 22 as shown in both FIGS. 1 and 2, the leading edge of the ram is clear of the vertically movable ram 20. The leading face of the ram carries a pair of spaced and flexible support plates 27 which lie in close proximity to the inner faces of the side plates 17. Conveniently the support plates are interconnected by an integral bridge member which is secured to the ram 22. As the ram 20 is moved to the lowered position in which it is seen in FIG. 2, a group of towels is pushed downwardly to between the supporting plates 27.

Forming part of the loader section 12 is a pair of hinged deflector plates 29. These plates are mounted about vertical pivots on the base plate 18. The plates are of angle section and the ends thereof remote from the lift section extend into the open end of a bag 30. When the ram 22 is moved to its advanced position the group of towels held between the plates 27 is moved between the deflector plates 29 into the open bag. The movement of the ram 22 continues and the towels reach the closed end of the bag. Further movement of the ram takes place but this position of its movement will be described later. While the ram 22 is moving as described, the vertically movable ram 20 is raised to receive a new group of towels.

Figure 7:
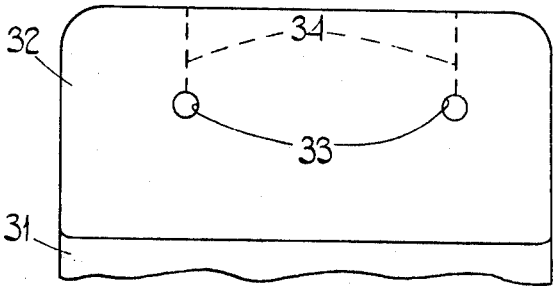
FIG. 7 shows a plan view of the end of a bag in which articles are inserted by the machine.

The bags 30 in the particular example are formed from heat sealable plastics material and the heat sealing is carried out in the sealing section 13, the sealing section comprising a conventional heat sealing unit. The bags are constructed in known manner with a bag portion 31 as seen in FIG. 7, one side of the bag portion being extended at the open end to form an extension 32. Furthermore, the extension is provided with a pair of spaced apertures 33 and lines of weakness 34 are provided between the apertures 33 and the adjacent common edge of the extension, the lines of weakness being defined by perforations.

It will be seen therefore that a batch of articles (plurality of articles) arranged in abutting parallel relationship are transferred from the conveyor to the receiving means formed between the parallel flexible plates 27 without any disturbance in their relative positions. Thereafter, the articles are caused to be laterally compressed by coaction of the flexible plates 27 against the hinged deflector plates 29. The hinged deflector plates 29 are held against the mouth of the bag 30, maintaining it open while the articles are compressedly inserted into the bag.

It will also be noted that the frame includes a pair of stationary walls 17 located respectively on the exterior of article receiving plates 27 and extend vertically upward above the conveyor. These walls 17 restrain outward deflection of the article receiving plates and maintain the batch in relative fixed orientation during transfer from the conveyor.

The deflecting plates 29 form a funnel, the leading ends of said deflector plates of which are extendable into the open end of the bag to insure that the bag is maintained in fully open condition during insertion of the batch. Each of these deflector plates are of an angle form including a base portion which is substantially vertically disposed, and which is pivotable adjacent its trailing end thereof about substantially vertical axis.

Figure 5:
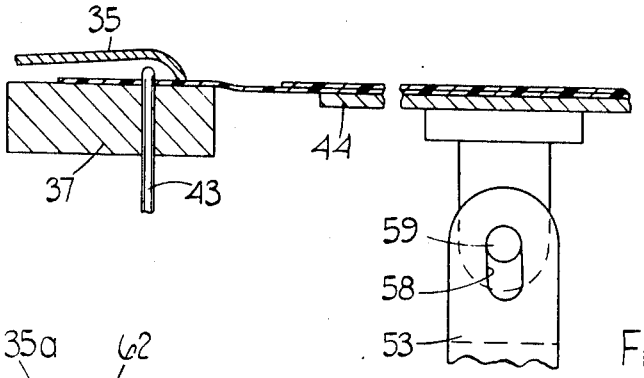
FIGS. 5 and 6 show a portion of the apparatus seen in FIG. 3 to an enlarged scale and at differing settings.
Figure 6:
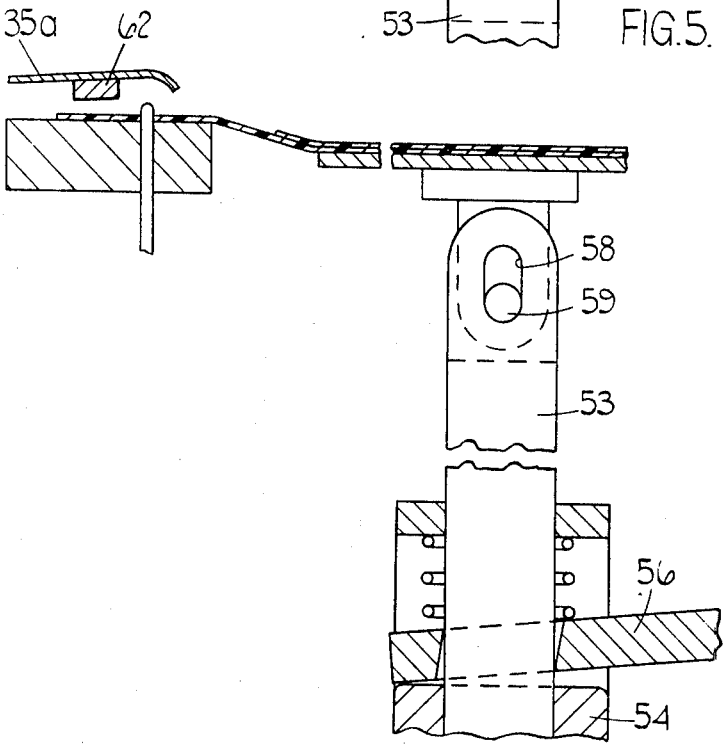

For holding the bags during the initial part of the filling operation as described above, there is provided a fixed upper gripping member 35 which extends laterally of the direction of movement of the ram 22. The gripping member also extends in the direction of movement of the towels and its trailing end is curved downwardly as shown in FIGS. 5 and 6 to form a gripping edge. The member at its leading edge is attached to a fixed part of the machine, the leading edge being disposed slightly below the base plate 18 as best seen in FIG. 2. Disposed between the base plate 18 and the upper gripping member is a block 36 which is bored to define an air passage having outlet jets facing in the direction of the bags.

Also provided is a lower gripping member 37 which, as een in FIGS. 2, 5 and 6, is positioned below the gripping member 35. Moreover, the lower gripping member extends in the direction of the path of movement of the towels so as to provide support for the aforesaid extensions 32 of the bags. The lower gripping member 37 is mounted for vertical movement on a pair of slides 38 which are themselves mounted on a base plate 39 which is itself laterally movable. For the latter purpose, the plate 39 is connected to a pair of parallel bars 40 carried in bearings 41 fixed to a supporting structure.

Figure 3:
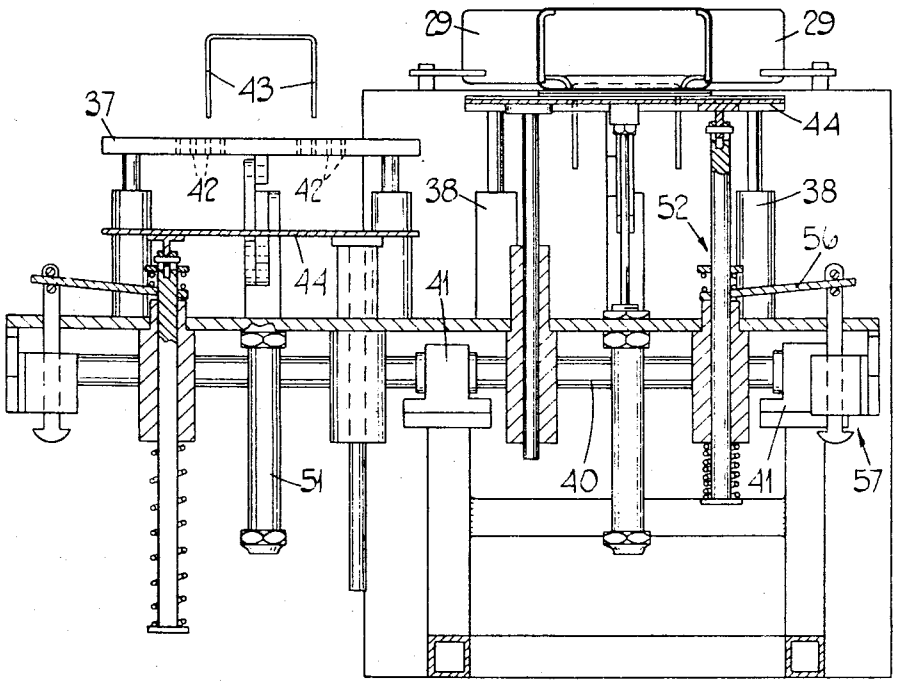
FIG. 3 is a sectional end elevation on the line 33 of FIG. 1.

The lower gripping member is provided with a plurality of apertures 42 best seen in FIG. 3 and in which can be located a pair of pegs 42 which pass through the apertures 33 in the extensions of the bags. As shown in FIG. 3, the pegs are interconnected and as seen in FIG. 5 in the raised position of the lower gripping member, the portion connecting the peg lies beneath the downwardly curved portion of the upper gripping member.

The bag portions of the bags are supported by a support plate 44 and this is mounted for vertical movement on the plate 39 by means of slides 45. Moreover, the lower gripping member 37 can be raised to ensure that the extensions 32 of the bags forming the stack of bags are firmly gripped between the gripping members.

The lower gripping member 37 and the support plate 44 are coupled by means of a lever system 46 which ensures that the plate 44 moves upwardly at a higher rate than the gripping member. This compensates for the fact that whereas each bag contributes a single thickness as far as the gripping members are concerned, it has at least two thicknesses on the support plate. The lever system comprises a first link 47 which at one end is pivotally connected to a fixed support 48 upstanding from the plate 39. This link is pivotally connected at a position removed from the pivot, to a short link 49 connected to the lower gripping member. At its other end, the main link 47 is pivotally connected to one end of a drop link 50, the other end of which is pivotally connected to the support plate 44. For raising the plate 44 and thereby through the lever system 46, the lower gripping member 37, a piston cylinder combination 51 is provided.

The arrangement of the lever system is such that, when the plate is positioned to receive a fresh supply of bags as seen on the left of FIG. 3, the plate is appreciably lower than the lower gripping member, the difference in the two levels decreasing as the bags are used.

During the sequence of operation of the machine, it is necessary to release the clamping pressure imposed by the gripping member 35, 37. This is achieved by releasing the air under pressure from the piston cylinder combination 51. When this is done, the lower gripping member 37 and the support plate 44 fall under the action of gravity. It is desirable, however, that the extent of fall should not be much more than is required to release the clamping pressure. This desirable feature is achieved using a self-adjusting stop.

Figure 4:
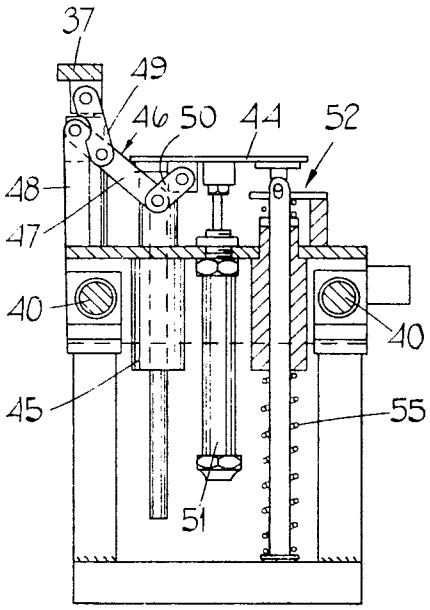
FIG. 4 is a view of part of the machine seen in FIG. 2 with the parts in a different position.

The self-adjusting stop is indicated at 52 in FIGS. 3 and 4, but its operation is best understood from FIGS. 5 and 6. The stop comprises a rod 53 slidable within a housing 54 carried by the plate 39. The rod is spring-loaded in the downwards direction by means of a coiled compression spring 55 (FIG. 4). The downward movement of the rod under the action of its spring is prevented by means of a spray arm 56 through an oblique aperture in which the rod extends. The sprag arm 56 is urged to the binding position by means of a coiled compression spring 57 and it can be moved from the binding position in which the aperture becomes aligned with rod, by means of a solenoid 57 having an armature connected to the arm.

At its upper end, the rod is provided with an elongated slot 58 in which is located a pin 59 mounted on the plate 44. When air under pressure is supplied to the piston cylinder combination 51, the pin 59 is moved to the upper end of the slot and, if required, upward movement of the rod 53 will take place because the sprag arm does not prevent upward movement of the rod. When the air pressure is released, the plate 44 will move downwardly under the action of gravity but the extent of downward movement is limited by the abutment of the pin with the lower end of the slot. Hence, although the gripping pressure is released, the downward movement of the gripping member 37 and support plate 44 is limited. When a fresh supply of bags is required, then the solenoid 57 is energized to allow the full downward movement of the gripping member 37 and support plate 44.

The operation of the machine has previously been described to the point where the group of towels has just reached the closed end of the bag. The ram 22 continues its movement and during the initial portion of the movement, the towels are compressed within the bag, the bag being firmly held against movement. The clamping pressure is then removed by lowering the support plate and lower gripping member and the bag starts to move with the ram during which time the aforesaid pegs 43 tear through the weakened portions 34 of the extension 32. The bag is then free to move with the ram which moves the bag into the bag sealing section 13. The movement of the bag continues until it encounters a stop and further slight movement of the ram effects further slight compression of the towels. Moreover, the bag is gripped and the ram retracted. Following retraction of the ram, the open end of the bag is quickly closed by a conventional heat sealing process before any substantial expansion of the towels has taken place. The closed bag is then discharged and the process repeated.

When the ram has been fully retracted, the extensions of the bags are again gripped and the aforesaid jets of air open up the upper bag so that it is open and engages about the ends of the deflection plates 29.

The resultant product is a lightly filled bag of towels a substantial contribution to the tightness of the packing being provided by the fact that the towels are compressed within the bag before the bag is removed from the stack.

The pegs 43 are only provided for the purpose of retaining the bags in stack form when the clamping pressure is removed. Other forms of retaining means could be provided to achieve this object.

FIG. 3 demonstrates that while the machine is using bags from one stack, a fresh stack of bags can be loaded onto the machine and brought into use when the one stack of bags is exhausted. The change-over may be achieved automatically using a double action piston cylinder combination acting between the supporting structure 19 and the plate 39. Switches 60, only one of which is shown, are operated at the extreme positions of the plate 39 respectively to determine the movement of the plate when a sensor 61 detects the use of the last bag of the stack of bags being currently used. Means is of course provided to ensure that the plate 39 is not moved until the last bag has been filled.

As described, the gripping member 35 extends to define a gripping edge which engages the bags on the side of the pins remote from the ram. As shown in FIG. 6, the bags can be gripped on the other side of the pins. In this case, the gripping member is constituted by a bar 62 which is positioned beneath the member 35a which acts as a deflector plate to guide the towels over the gripped ends of the bags.

What is claimed is:

1. In a machine for packaging a batch of semi-compressible articles into preformed bags open at one end, apparatus for inserting said batch in said bags comprising a longitudinal ram movable toward and away from said open bag, batch receiving means located at the leading end of said ram to carry said batch into said open bag, said batch receiving means comprising a pair of generally elongated flat parallel walls extending forwardly of the leading end of said ram and spaced from each other to receive a plurality of articles forming a batch therebetween, at least one of said walls being flexible along its length, means located at the entrance of said bag to deflect said flexible wall transversely of the direction of movement so as to impart a compressive force upon the articles in said batch as they are inserted into said bag.

2. A machine according to claim 1, wherein said walls of said batch receiving means are each formed of flexible material and are integrally secured to the front face of said ram to extend cantilevered forwardly therefrom.

3. A machine according to claim 1, including an endless conveyor to feeding a plurality of articles in a relatively fixed oriented batch to said ram, said conveyor being disposed in line with and above said ram, and includes a pusher member movable in a vertical direction intersecting the line of movement of said ram, said pusher member cooperating with said conveyor to transfer said batch from said conveyor to said article receiving means.

4. A machine according to claim 3, including a pair of stationary walls located respectively on the exterior of said article receiving means and extending vertically upward above said conveyor, said walls restraining outward deflection of said batch receiving means and maintaining said batch in relative fixed orientation during such transfer.

5. A machine according to claim 1, wherein said means for deflecting said flexible plate comprises a funnel formed of a pair deflector plates spaced so as to permit the batch to pass therebetween within said article support means, the leading ends of said deflector plates being extendable into the open end of the bag to insure that the bag is maintained in fully open condition during insertion of the batch.

6. A machine according to claim 1, wherein at least one of said deflector plates is of an angle form including a base portion which is substantially vertically disposed, said one deflector plate being pivotable adjacent the trailing end thereof about substantially vertical axis.

* * * * *